US005559528A

United States Patent [19]

Ravid et al.

[11] Patent Number: 5,559,528

[45] Date of Patent: Sep. 24, 1996

[54] DISPLAY HAVING REDUNDANT SEGMENTS

[75] Inventors: Arie Ravid, Palo Alto; Robert G. Poli, Campbell, both of Calif.

[73] Assignee: Abbott Laboratories, Abbott Park, Ill.

[21] Appl. No.: 125,508

[22] Filed: Sep. 21, 1993

[51] Int. Cl.[6] ..... G09G 3/04

[52] U.S. Cl. ..... 345/117; 345/34; 340/815.44

[58] Field of Search ..... 345/50, 34, 117, 345/904, 93, 4, 33, 35, 40, 51; 340/642, 815.44, 815.53, 815.47, 507; 313/510, 513, 514, 517, 519

[56] References Cited

U.S. PATENT DOCUMENTS

| | | | |
|---|---|---|---|
| 3,127,535 | 3/1964 | Westerheim | 345/4 |
| 3,840,873 | 10/1974 | Usui | 340/815.53 |
| 3,892,471 | 7/1975 | Biermann et al. | 313/517 |
| 4,000,437 | 12/1976 | Lederhandler et al. | 313/510 |
| 4,086,514 | 4/1978 | Havel | 313/510 |
| 4,301,450 | 11/1981 | Smoliar | 345/117 |
| 4,309,699 | 1/1982 | Taver | 345/117 |
| 4,328,490 | 5/1982 | Usuba et al. | 345/117 |
| 4,371,870 | 2/1983 | Biferno | 345/4 |
| 4,395,654 | 7/1983 | Hattori et al. | 313/513 |
| 5,001,468 | 3/1991 | Brice et al. | 345/50 |
| 5,216,414 | 6/1993 | Fukutani et al. | 345/93 |
| 5,221,918 | 6/1993 | Boehner | 340/642 |
| 5,406,301 | 4/1995 | Ravid | 345/34 |

FOREIGN PATENT DOCUMENTS

| | | | |
|---|---|---|---|
| 2205888 | 8/1990 | Japan | 345/117 |

*Primary Examiner*—Richard Hjerpe
*Assistant Examiner*—Kara Farnandez Stoll
*Attorney, Agent, or Firm*—Christensen O'Connor Johnson & Kindness PLLC

[57] ABSTRACT

Redundant segment display characters are used to provide a fail-safe indication of critical parameters. In one preferred form of the invention, selected segments of a redundant segment character include pairs of segments that are arranged proximate to each other and extend generally parallel to each other. The pairs of redundant segments are activated simultaneously in response to multiplexed fore plane and back plane drive signals applied to conductive regions of a liquid crystal display. The remaining portions of the redundant segment character each comprise single activated regions. The portions of the display character that include redundant segments are selected to minimize errors in reading a numeric value indicated by the character in the event that one of the segments fails to operate properly. In another preferred form of the invention, all of the portions of the character are pairs of redundant segments. In yet another embodiment, the pairs of redundant segments are arranged serially, end-to-end. In the event that one of the redundant segments fails to activate or always remains activated, such failure is visually apparent to an operator by comparison to the other segment of the redundant pair.

26 Claims, 7 Drawing Sheets

DISPLAY HAVING REDUNDANT SEGMENTS

FIELD OF THE INVENTION

This invention generally relates to a digital display, and more specifically, to a display that includes a plurality of segments that are selectively energized to indicate a specific alphanumeric character.

BACKGROUND OF THE INVENTION

In a conventional alphanumeric display, a plurality of individual segments are selectively energized to visually represent a desired character. The most common type of display includes at least seven discrete segments arranged so as to visually represent a numeral eight if all of the segments are simultaneously energized. Although this type of display can represent a limited number of alpha characters, it is most often employed to represent the numbers zero through nine. Substantially the same seven segment configuration (although fabricated very differently for the two types of display technologies) can be used for both light emitting diode (LED) displays and liquid crystal displays (LCDs).

There are several advantages that justify using LCDs rather than LEDs in instrument displays. Particularly important in portable, battery powered instruments is the intrinsically lower power requirement of the liquid crystal technology. In addition, relatively complex arrangements of graphic icons and alphanumeric character displays can readily be configured on a common substrate to produce a complete LCD panel for an instrument. By contrast, LED displays are more directed to characters than graphic icons and not as easily fabricated as complex, integrated panels.

Each segment of an LCD corresponds to similarly shaped electrically conductive regions applied to the front and rear surfaces of the display. These electrically conductive regions are coupled to a control circuit that supplies a voltage appropriate to modify the optical characteristics of a liquid crystal layer disposed between the front and rear surfaces. The electrical signal applied to these regions causes the liquid crystal layer to become more opaque, so that a character or graphic icon corresponding to the shape of the electrically conducting regions is visible. Optionally, background lighting can be provided for an LCD to produce greater contrast so that the characters or icons are more easily visible at low ambient light levels.

There are certain applications in which a failure of one of the segments that defines a character or graphic icon may have life-threatening consequences. For example, a display panel on a medical instrument may indicate certain critical operating parameters to an operator of the instrument. Clearly, in this instance, it is very important to avoid errors in reading the displayed data. An error caused by the failure of a segment in a numeric display character would be particularly serious if the character is the most significant digit of a critical displayed value. For instance, failure of the center segment in a seven segment character of the display would cause a "0" to visually appear as an "8." A medical practitioner relying on the incorrect displayed reading caused by such a failure might use the instrument in a manner that harms a patient. Accordingly, for any critical displayed parameter on a medical instrument, designers have recognized the importance of detecting a display failure so that the user is alerted and does not rely upon an incorrect value.

One way to insure that a failure in a critical display character is detected is to duplicate the entire displayed parameter, so that two nominally identical values for the parameter are indicated in separate displays. If the two displayed values are different, the user is supposed to recognize that a failure has occurred in one of the duplicated displays. However, because the two displayed values are spatially separate, such difference may go unnoticed. Moreover, space limitations on a display panel often render it impractical to provide duplicate values of a parameter, and this solution to the problem is inelegant at best.

If LEDs are used for such critical displayed parameters, the electrical current to each digit of the display can be monitored and compared to an expected value in a look-up table that relates each of the possible characters to the electrical current draw required for that character, based on the number of segments that must be selectively energized to represent it. For example, a numeral "1" requires that only two segments be energized (in a seven segment display), and the look-up table defines a current corresponding to that required by the two segments. If less current is detected, at least one of the two segments may have failed and a monitoring circuit alerts the operator with a visual and/or audible alarm. Similarly, if current to a segment is detected when that segment should not be energized, the monitoring circuit also detects a failure.

Unfortunately, the low current requirements of LCDs make it practically impossible to detect a failed segment in an LCD character based on electrical current measurements. Consequently, although LCDs are almost uniformly preferred for display panels because of the variety of graphic options that can be included and because of their low power requirement, LEDs are often used for the display of critical parameter values, simply to ensure that the failure of a segment in the critical display can be detected by the current monitoring method. Consequently, both an LCD display panel and LEDs must be used on such instruments. It should be evident that it would be preferable to use only LCDs in a display panel, if failure of a segment of any LCD characters was clearly evident, especially if such a failure did not preclude the correct character from being visually perceived.

SUMMARY OF THE INVENTION

In accordance with the present invention, a display includes a substrate on which is defined a circuit of conducting traces. A plurality of segment pairs are electrically coupled to the conducting traces and are configured in a predefined pattern on the substrate. At least some of the segments are configured in segment pairs, where each segment pair includes a first and a second segment, disposed proximate to each other and extending in a common direction, but spaced apart from each other. Each segment pair comprises a portion of at least one icon character. Segment control means, coupled to the first and second segments, are provided to cause selected ones of the segment pairs to be visually perceptible, i.e., to visually represent a desired icon character. A defective segment pair that includes both a failed segment and an operating segment remains visually perceptible as part of the desired icon character. Furthermore, the failed segment provides a visual warning that one of the first and second segments comprising that defective segment pair has failed.

The segment control means are separately coupled to the first and second segments comprising the selected segment pairs, so that the first and second segments comprising each segment pair are both selectively activated and inactivated by the segment control means. Preferably, the segment pairs comprise LCD regions, and each region is defined by a patterned conductor formed on the substrate and electrically coupled to the conducting traces. In addition, the segments preferably represent a numeral eight if all segments are simultaneously visually perceptible.

Seven segment pairs are provided in one preferred form of the invention, and the segment control means selectively cause specific ones of the seven segment pairs to be visually perceptible, to represent at least the numerals zero through nine. Alternatively, the substrate includes regions that define a plurality of characters, with at least some of the regions comprising the segment pairs.

In another embodiment, the segment pairs are used only for portions of a character. The portions of the character for which the segment pairs are used are selected to minimize errors in visual perception of an alphanumeric character indicated by the display that might otherwise be caused by a failure of one of the first and second segments comprising any of the segment pairs representing the character. In this embodiment, the non-redundant segment portions of the character are less likely to cause an error in reading the displayed value if they fail. In one preferred form of the invention, the segment pairs are arranged so that the segments comprising a pair are parallel to each other, and in another preferred embodiment, they are arranged end-to-end.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figures 1, 2, 3:
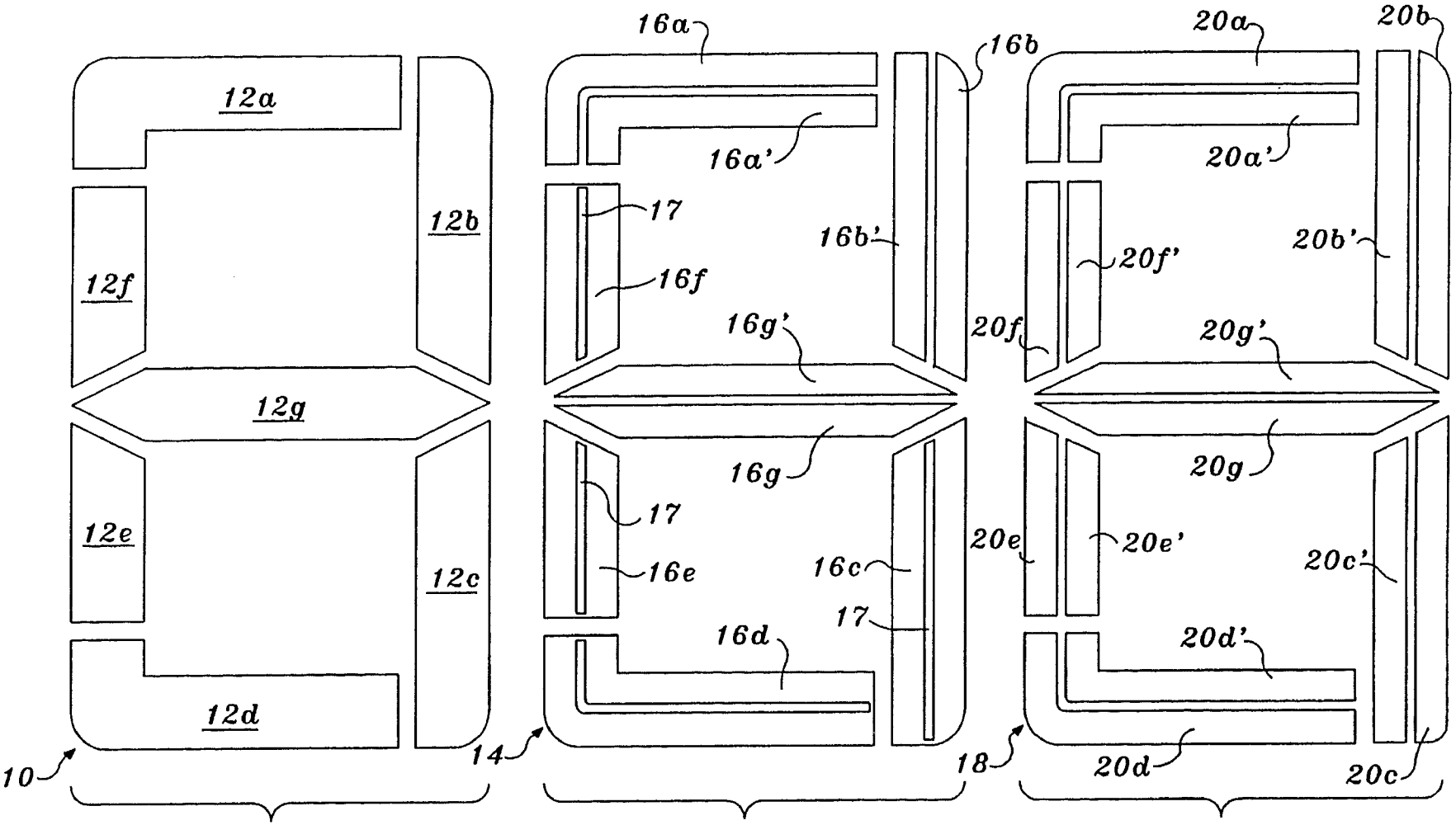
FIG. 1 PRIOR ART
FIG. 1 is an enlarged plan view of the segments comprising a prior art seven segment LCD character.
FIG. 2 is an enlarged plan view of the segments comprising a first embodiment of the present invention, in which segments comprising certain portions of a character are redundant and separately driven to minimize display errors that might be caused by failure of a segment.
FIG. 3 is an enlarged plan view of a second embodiment of the present invention in which all portions of the seven segment configuration are provided with pairs of redundant segments, in which the redundant segments of a pair extend parallel to each other.

As shown in FIG. 1, a prior art seven segment alphanumeric display character 10 includes segments 12*a* through 12*g* arranged to visually represent a numeral "8" when all segments of the display are simultaneously energized. This type of display is primarily used for representing the numerals 0 through 9, but can also be used to represent a limited number of alpha characters such as A, B, C, E, F, H, I, J, L, P, S, U, etc. As noted above in the background of the invention, the configuration of display character 10 can be embodied in either an LCD or as an LED display. However, if certain of the segments become inoperative either because they remain continually energized, or fail to be visually perceptible when they should be, display character 10 can cause an erroneous indication. The present invention addresses this problem.

A first embodiment of a redundant segment display in accordance with the present invention is shown in FIG. 2, generally at reference numeral 14. From a distance, redundant segment display 14 also appears to comprise seven segments, but on closer inspection, it is apparent that specific orthogonal portions of the display actually comprise two separate segments that extend generally parallel to each other. For example, segment pairs 16*a* and 6*a'*, 16*b* and 16*b'*, and 16*g* and 16*g'* each include two separate segments that are separately activated. Each of the two segments comprising such a pair are normally always active or inactive at the same time, at least, unless a failure has caused one of the segments comprising the pair to operate improperly. In addition to these pairs of redundant segments, the remaining segments 16*c*, 16*d*, 16*e*, and 16*f*, which do not comprise redundant segments, all include a narrow strip 17 running generally longitudinally through the center of each of the segments (except at the ends thereof), giving these segments the appearance of two parallel halves, consistent with the appearance of the pairs of redundant segments. Unlike the pairs of redundant segments, which include two segments that are separately activated, each of segments 16*c*, 16*d*, 16*e*, and 16*f* comprise only a single LCD region.

It should be noted that redundant segment display 14 and each of the other embodiments of the present invention that are shown in the figures yet to be discussed are illustrated to show the visible portion of the LCD layer effected by activating selected segments of each character. Those of ordinary skill in the art will appreciate that a typical LCD panel includes a layer of liquid crystal material sandwiched between two clear sheets of glass or other transparent dielectric material. Conductive coatings are applied to the outer surfaces of the these two sheets to define the segment regions of the liquid crystal material that are made visible when an electric field is generated in response to a voltage differential between the conductive coatings. Since the technique used to define segments and the regions comprising other types of icons in a LCD panel are well know to those of ordinary skill in the art, they need not be further discussed to provide an enabling disclosure for the present invention. By multiplexing the signals applied to the conductive regions on the front outer surface of the display with the signals applied to the conductive regions on the back outer surface of the display, selected portions of each character or icon can be activated so that they are visually evident due to the change in the optical properties of the liquid crystal material caused by the resulting electrical field. The conductive regions on the outer front surface of the display are referred to herein as the fore plane regions, while those on the back of the display are referred to as the back plane regions.

Figure 5:
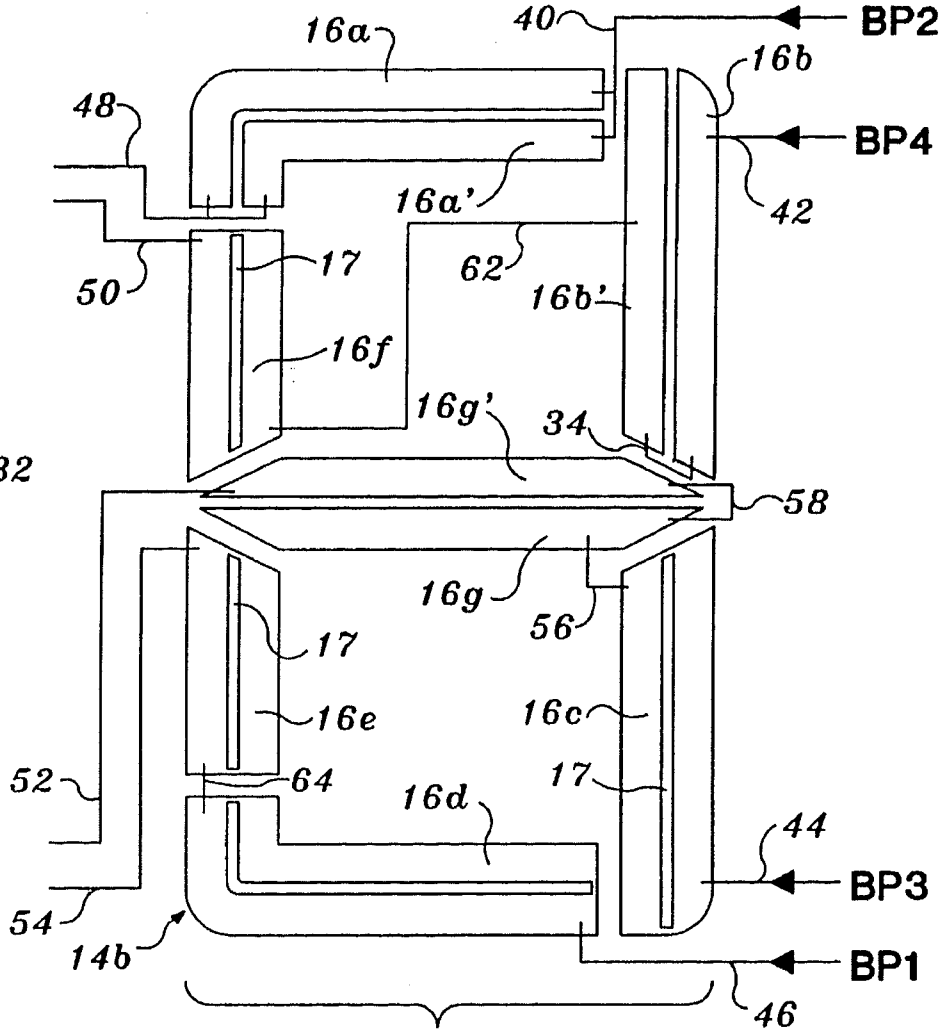
FIG. 5 is a schematic view like that of FIG. 2, illustrating the back plane conductive regions and traces for providing the drive signals.
Figure 4:
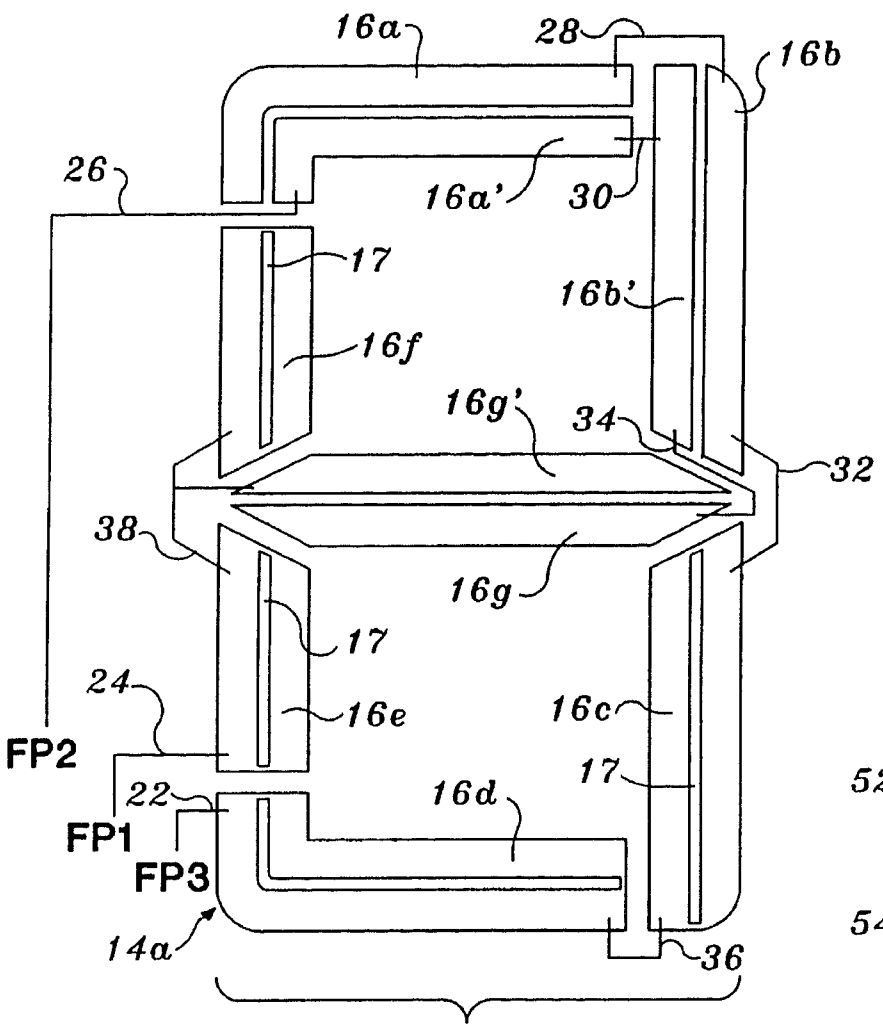
FIG. 4 is a schematic view like that of FIG. 2, illustrating the fore plane conductive regions and traces for providing the drive signals.

FIGS. 4 and 5 illustrate how different selected fore plane and back plane regions are interconnected with signals that are applied through optically transparent, electrically conductive traces. For example, as shown in FIG. 4, electrically conducting traces 22, 24, and 26 convey a signal to the electrically conductive fore plane regions for segments 16*d*, 16*e*, and 6*a'*, respectively. (It should be noted that to simplify the drawings, the same reference numerals used in connections with the segments are used with the corresponding fore plane and back plane conductive regions comprising those segments, since they have the same shape as the liquid crystal material that is visually apparent when a segments is activated. The fore plane region for segment 6*a'* is coupled through an interconnecting trace 30 to the fore plane region for segment 16*b'*, while the fore plane region for segment 16*a* is coupled through an interconnecting trace 28 to the fore plane region for segment 16*b*. Similarly, the fore plane region for segment 16*b* is connected to the fore plane region for segment 16*c* by an interconnecting trace 32, and the fore plane region for segment 16*b* is connected to the fore plane region for segment 16*g* through an interconnecting trace 34. An interconnecting trace 36 couples the fore plane regions for segments 16*d* and 16*c*, while an interconnecting trace 38 couples the fore plane regions for segments 16*e*, 16*f*, and 16*g'* together.

Back plane regions 14*b* are shown in FIG. 5, along with the interconnecting traces used to convey multiplexing signals to the back plane regions to energize selected segments. Back plane signals are conveyed over conducting traces 40, 42, 44 and 46 to the back plane regions for segments 16*a* and 6*a'*, 16*b*, 16*c*, and 16*d*, respectively. The same signals are conveyed to other display characters on the display panel (not shown in this figure) through conductive traces 48, 50, 52, and 54, which are respectively connected to the electrically conductive back plane regions for segments 16*a* and 6*a'*, 16*f*, 16*g'*and 16*e*. Interconnecting traces convey the back plane multiplexing signals between the conductive back plane regions for different segments. Specifically, an interconnecting trace 60 connects the back plane regions for segments 16*b* and 16*b'*, while an interconnecting trace 62 connects the back plane region for segment 16*b* to the back plane region for segment 16*f*. Similarly, interconnecting traces 56, 58, and 64 interconnect the back plane regions for segments 16*c* and 16*g*, 16*g* and 16*g'*, and 16*d* , and 16*e*, respectively.

The specific back plane regions coupled to the back plane signals are selected so as to minimize the adverse affect of a failure occurring in connection with one of the LCD segments of redundant segment display 14. Table 1, which follows below, discloses the segments of redundant segment display 14 that are activated in response to the fore plane and back plane multiplexing signals. For example, in response to the combination of a fore plane signal FP1 and a back plane signal BP1, segment 16*e* is activated. Furthermore, the combination of fore plane signal FP1 and a back plane signal BP3 activates a segment 16*g'*, and the combination of fore plane signal FP1 and a back plane signal BP4 activates segment 16*f*. Similarly, different combinations of the fore plane and back plane signals activate other segments of display 14, as indicated in Table 1.

TABLE I

| | Fore Plan 1 (FP1) | Fore Plane 2 (FP2) | Fore Plane 3 (FP3) |
|---|---|---|---|
| Back Plane 1 (BP1) | Segment 16e | — | Segment 16d |
| Back Plane 2 (BP2) | — | Segment 16a' | Segment 16a |
| Back Plane 3 (BP3) | Segment 16g' | Segment 16g | Segment 16c |
| Back Plane 4 (BP4) | Segment 16f | Segment 16b' | Segment 16b |

The segments that are energized in response to fore plane and back plane signals and the type of error that occurs in the event that the segment either remains energized when it should be de-energized, or fails to become energized in response to the multiplexed signals are shown below in Table 2. As noted in Table 2, because redundant segments are provided for selected portions of redundant display 14, the desired character is visually perceptible even though a segment failure has occurred, and/or, the resulting visual display generally provides a visual indication that a failure has occurred, which would alert the user not to rely upon the display to accurately represent a critical parameter. The visual indication is apparent when only one of a pair of redundant segments is active or when the overall display visually fails to represent an expected character because one or more of the segments needed to represent a recognizable expected character are either activated or not activated.

TABLE 2

| TYPE OF FAILURE | RESULT |
|---|---|
| Conductive trace 46 for BP1 is open. | Segments 16d, 16e are inactive, causing an "8" to appear as a "9". |
| Conductive trace 40 for BP2 is open. | Segments 16a, 16a' are inactive, causing a "7" to appear like a "1". |
| Conductive trace 44 for BP3 is open. | Segments 16g, 16g', & 16c are inactive-alert due to indication of a non-numeric character. |
| Conductive trace 42 for BP4 is open. | Segments 16b, 16b', & 16f are inactive-alert due to indication of a non-numeric character. |
| Conductive trace 24 for FP1 is open. | Segments 16e, 16f, & 16g' are inactive-alert due to indication of a non-numeric character. |
| Conductive trace 26 for FP2 is open. | Segments 16a', 16b', & 16g are inactive-alert due to indication of a non-numeric character. |
| Conductive trace 22 for FP3 is open. | Segment 16a, 16b, 16c, & 16d are inactive-alert due to indication of a non-numeric character. |
| Segment 16a is always active. | A "1" may appear as a "7" and a "4" may appear as "9"-visual indication of failed segment. |
| Segment 16a is always inactive. | Segment 16a' remains visually perceptive-visual indication of failed segment. |
| Segment 16a' is always active. | A "1" may appear as a "7" and a "4" may appear as "9"-visual indication of failed segment. |
| Segment 16a' is always inactive. | Segment 16a remains visually perceptive-visual indication of failed segment. |
| Segment 16b is always active. | Visual indication of failed segment because segment 16b' not always active. |

TABLE 2-continued

| TYPE OF FAILURE | RESULT |
|---|---|
| Segment 16b is always inactive. | Visual indication of failed segment because segment 16b' not always inactive. |
| Segment 16b' is always active. | Visual indication of failed segment because segment 16b is not always active. |
| Segment 16b' is always inactive. | Visual indication of failed segment because segment 16b is not always inactive. |
| Segment 16c is always active. | Alert due to indication of a non-numeric character. |
| Segment 16c is always inactive. | Alert due to indication of a non-numeric character. |
| Segment 16d is always active. | Alert due to indication of a non-numeric character. |
| Segment 16d is always inactive. | Alert due to indication of a non-numeric character. |
| Segment 16e is always active. | Alert due to indication of a non-numeric character. |
| Segment 16e is always inactive. | Alert due to indication of a non-numeric character. |
| Segment 16f is always active. | A "3" may appear as a "9". |
| Segment 16f is always inactive. | Alert due to indication of a non-numeric character. |
| Segment 16g is always active. | A "0" may appear as an "8"-visual indication of failed segment because segment 16g' is not always active. |
| Segment 16g is always inactive. | Visual indication of failed segment because segment 16g' is not always inactive. |
| Segment 16g' is always active. | A "0" may appear as an "8"-visual indication of failed segment because segment 16g is not always active. |
| Segment 16g' is always inactive. | Visual indication of failed segment because segment 16g is not always inactive. |

Careful review of Table 2indicates that certain errors can occur, e.g., causing one character to appear as another character, without any indication of the failure of a segment being evident. For example, when segment 16*f* is always active, a "3" appears as a "9." In other instances, failure of a segment is evident either because the redundant segment continues to operate properly, or because the visual indication that results due to the failed segment does not represent an expected numeric digit 0 through 9. Accordingly, most errors are either self-evident or readily detected, causing a user to avoid relying upon the indicated value.

A second alternative embodiment of a redundant segment display 18 is illustrated generally in FIG. 3. In this embodiment, redundant segment display 18 includes fourteen liquid crystal regions arranged in seven pairs of redundant segments 20; the two segments comprising each pair extend generally parallel to each other. From a distance, redundant segment display 18 appears virtually identical to prior art seven segment character 10. Each segment comprising a pair of redundant segments is separately controlled, but is activated at the same time as the other segment comprising the pair. Thus, for example, segments 20*a* and 20*a'* are activated and inactivated simultaneously to visually indicate the top portion of redundant segment display 18. In a similar manner, each segment of a pair, including segments 20*b* and 20*b'*, 20*c* and 20*c'*, 20*d* and 20*d'*, 20*e* and 20*e'*, 20*f* and 20*f'*, and 20*g* and 20*g'*, are respectively separately controlled but function together. As a result, for example, if segment 20*b'* should fail, either by being always activated or always inactivated, the failure will be evident by visual comparison to segment 20*b*, which continues to operate properly.

Since the electrically conductive fore plane and back plane regions used for redundant segment display 18 appear identical to the LCD regions 20 illustrated in FIG. 3, they are not separately illustrated, nor are the conductive traces that couple the fore plane and back plane drive signals to these conductive regions. Those of ordinary skill in the art will appreciate that there is no need to show the conductive traces for the embodiment of FIG. 3, since they are generally the same as those used in the prior art, except that duplicate conductive traces are provided for each portion of redundant segment character 18, i.e., to separately control each of the segments comprising each pair of segments. Additional details of two preferred forms of the drive circuitry are discussed below, in connection with FIGS. 11 and 12.

Figure 6:
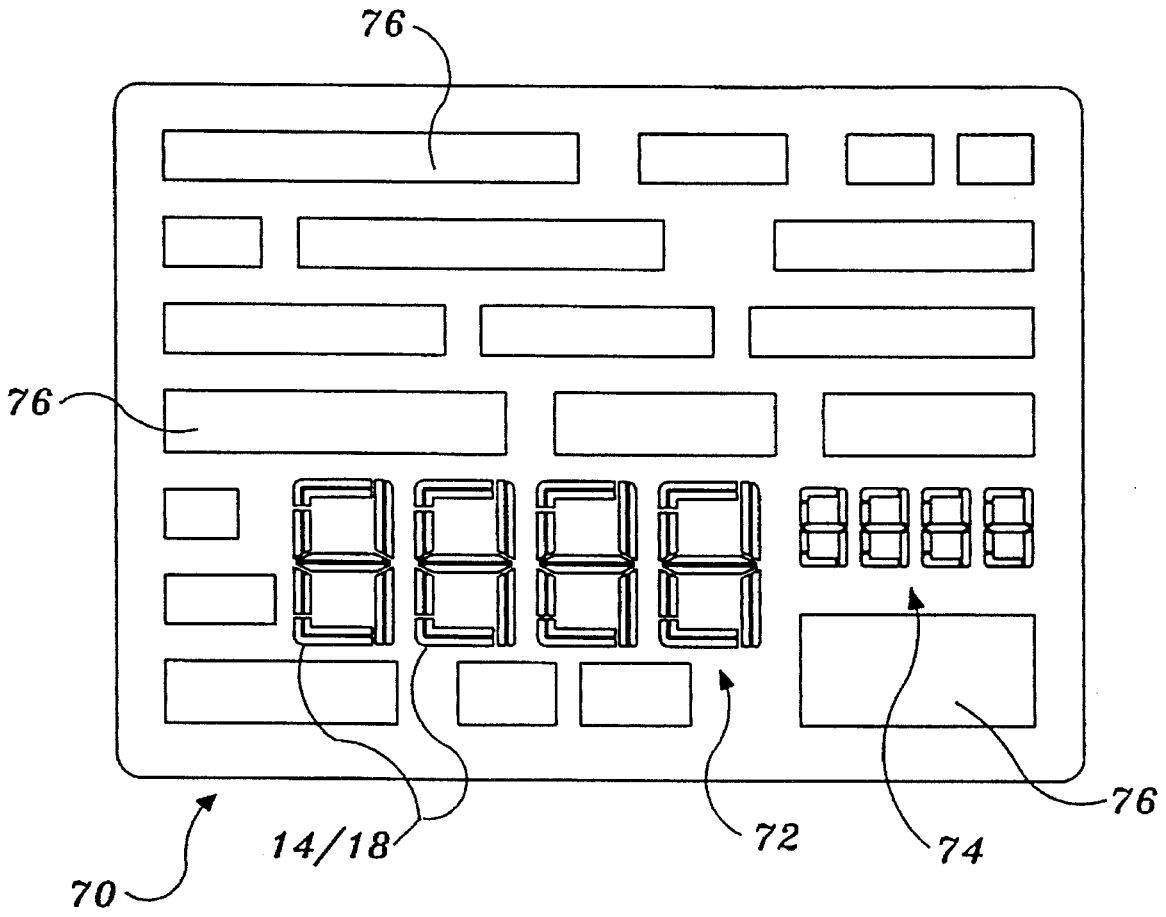
FIG. 6 is a schematic plan view of a display panel incorporating the present invention.

FIG. 6 shows how a plurality of redundant segment characters 14 or 18 are configured on a display panel 70 to indicate a critical parameter. Four such redundant segment display characters comprise an LCD readout 72 on display panel 70, enabling an operator to detect many, if not all, failures that may occur in one or more of display characters 14/18, as already discussed above. Another display region 74, uses prior art seven segment display characters 10 to represent a less critical value. In addition, a plurality of regions 76 on display panel 70 are used to visually indicate alarms and other information to the user.

Figure 7:
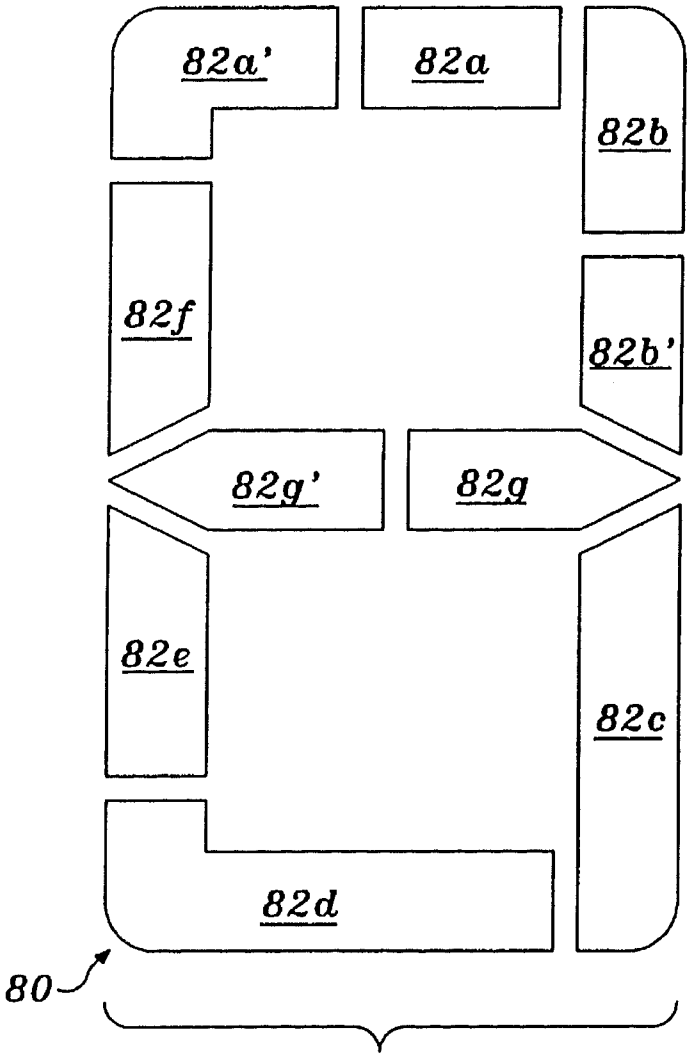
FIG. 7 is an enlarged plan view of a third embodiment of the present invention, in which segments comprising certain portions of a character include redundant pairs of segments, the segments comprising each redundant pair being arranged end-to-end.

A third embodiment of a redundant segment display character 80 is shown in FIG. 7. This embodiment is similar in some respects to redundant segment display 14, shown in FIG. 2. However, instead of using selected pairs of redundant segments that extend generally parallel to each other for selected portions of the character, in display character 80, these pairs of redundant segments are serially arranged, end-to-end. Specifically, a pair of segments 82*a* and 82*a'* are arranged end-to-end, so that together, they define the top portion of redundant segment character 80, while a pair of segments 82*b* and 82*b'* are arranged end-to-end to form the upper right portion of the character. A pair of segments 82*g* and 82*g'* comprising the remaining redundant segment portion, extending horizontally across the center of the character. The other segments comprising display character 80, including segments 82*c*, 82*d*, 82*e* and 82*f*, are generally conventional.

Figure 10:
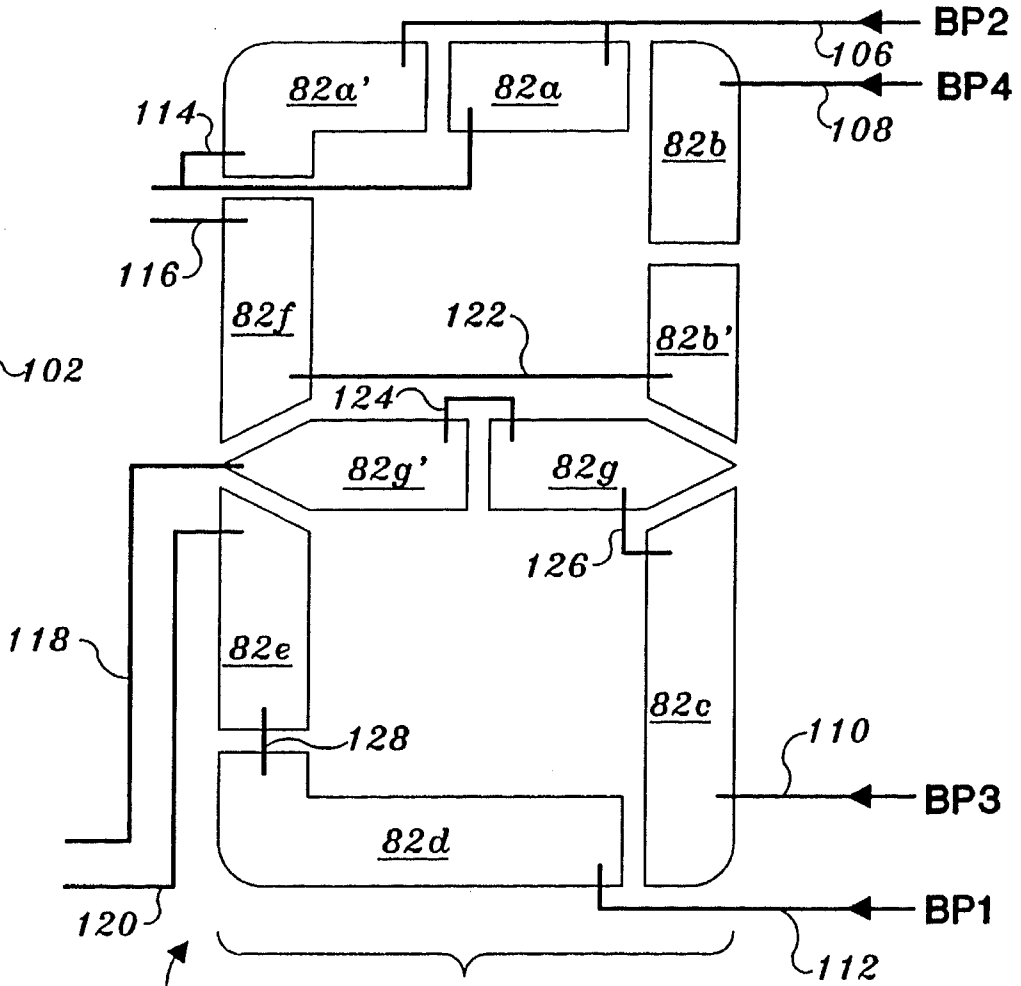
FIG. 10 is a schematic view like that of FIG. 8, illustrating the back plane conductive regions and traces for providing the drive signals to this embodiment.
Figure 9:
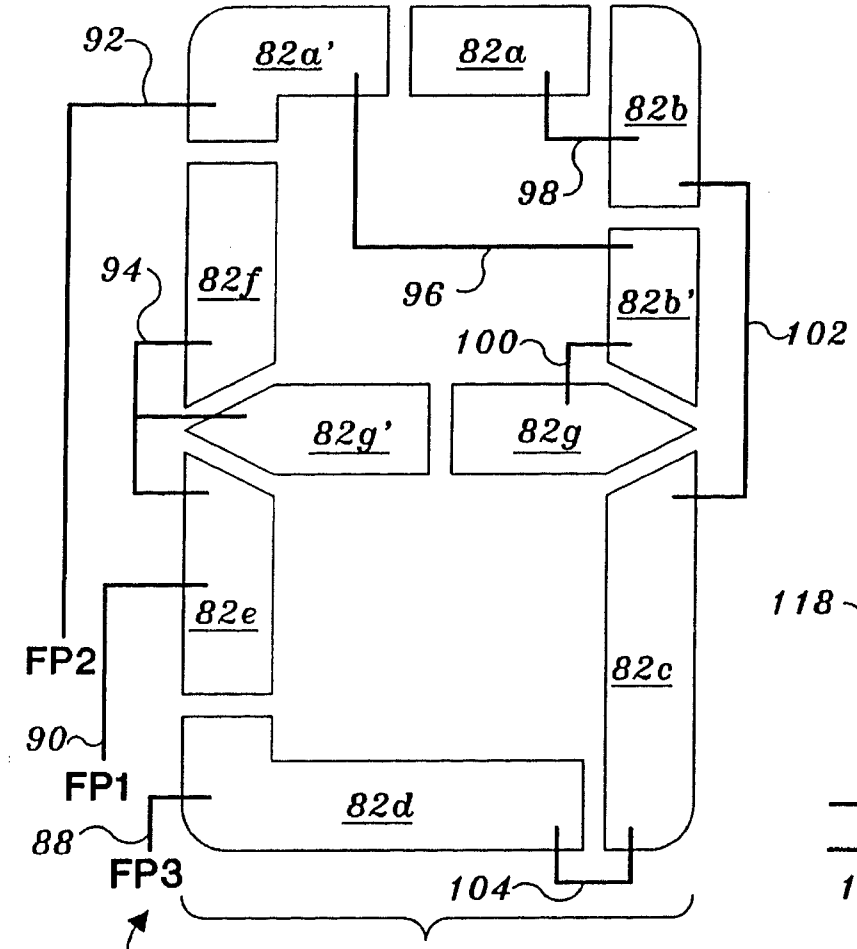
FIG. 9 is a schematic view like that of FIG. 8, illustrating the fore plane conductive regions and traces for providing the drive signals to this embodiment.

Each of the pairs of segments 82*a* and 82*a'*, 82*b* and 82*b'*, and 82*g* and 82*g'* are respectively separately activated in response to multiplexed fore plane and back plane signals applied to the electrically conductive regions shown in FIGS 9 and 10. Referring to FIG. 9, electrically conductive traces 88, 90 and 92 are respectively coupled to electrically conductive regions corresponding to segments 82*d*, 82*e*, and 82*a'* on the fore plane of redundant segment character 80. Once again, these electrically conductive regions correspond to the LCD regions of FIG. 7 and are identified with identical reference numerals. Interconnecting electrical traces 94 couple electrically conductive regions for segments 82*f*, 82*g'* and 82*e* together. An electrically conductive region for segment 82*a'* is coupled through interconnecting trace 96 to a region for segment 82*b'*, which in turn is connected to region for segment 82*g* through an interconnecting trace 100. An interconnecting trace 98 couples regions for segments 82*a* and 82*b*, and the region for segment 82*b* is coupled through an interconnecting trace 102 to a region for segment 82*c*. Finally, an interconnecting trace 104 couples the regions for segments 82*c* and 82*d*.

Referring now to FIG. 10, the back plane signals used for multiplexing selected segments are supplied through electrically conductive traces 106, 108, 110 and 112 to electrically conductive regions for segments 82*a* and 82*a'*, 82*b*, 82*c*, and 82*d*, respectively. The corresponding back plane drive signals are conveyed to other display characters on the panel (not shown) through electrically conductive traces 114, 116, 118, and 120, which are respectively coupled to back plane regions for segments 82*a'* and 82*a* , 82*f*, 82*g'*, and 82*e*. Interconnecting traces couple various back plane regions together, including regions for segments 82*f* and 82*b'*, which are coupled through an interconnecting trace 122, and regions for segments 82*g* and 82*g'*, which are coupled through an interconnecting trace 124. Similarly, an interconnecting trace 126 couples a region for segment 82*g* to a region for segment 82*c*, and an interconnecting trace 128 couples a region for segment 82d to a region for segment 82*e*.

The fore plane and back plane drive signals to redundant segment character 80 activate the segments in a manner similar to that represented for redundant segment character 14 in Table 1 above. Likewise, the various possible failure conditions and results that applied to redundant segment character 14 as set forth in Table 2 are also applicable to redundant segment character 80.

Figure 8:
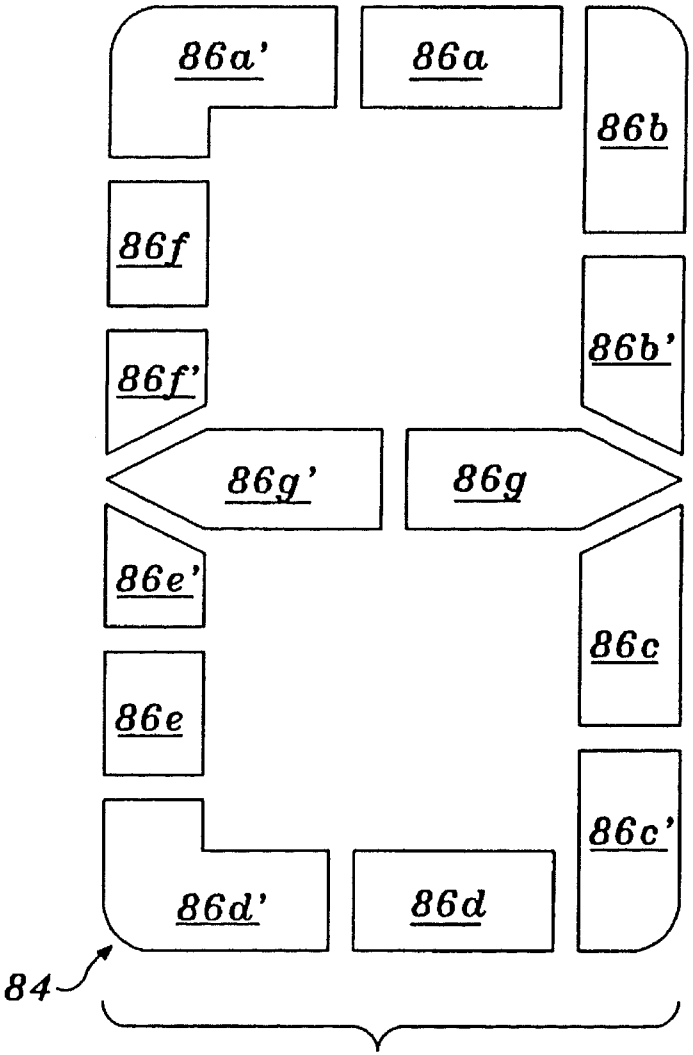
FIG. 8 is an enlarged plan view of a fourth embodiment of the redundant segment character, in which all of the segments comprises redundant pairs of segments, the segments comprising each redundant pair being arranged end-to-end.

The final preferred embodiment of a redundant segment display 84 is shown in FIG. 8. In this redundant segment character, each of the segments comprising a seven segment display character are divided into pairs of redundant segments, in which each segment comprising a pair is separately activated. As before, each pair of redundant segments is represented using the same numeric reference numerals, but with prime and unprimed designations being used to distinguish between them. For example, the top portion of redundant segment character 84 comprises a pair of segments 86*a* and 86*a'*, which are separately controlled, but are activated and inactivated at the same time. In the event that one segment of any pair of segments should fail, such failure is visually evident, since the other properly operating segment of the pair continues to visually indicate the desired character, and/or show that a failure has occurred. In that sense, redundant segment character 84 is analogous to redundant segment character 18, shown in FIG. 3. Even if a failure causes one of the segments comprising a pair to be always active, the failure should be evident, since the other properly operating segment of the redundant pair will not always be active. An operator will thus be alerted to the failure, since the display with appear with a segment portion that is about one-half the normal length.

Figure 11:
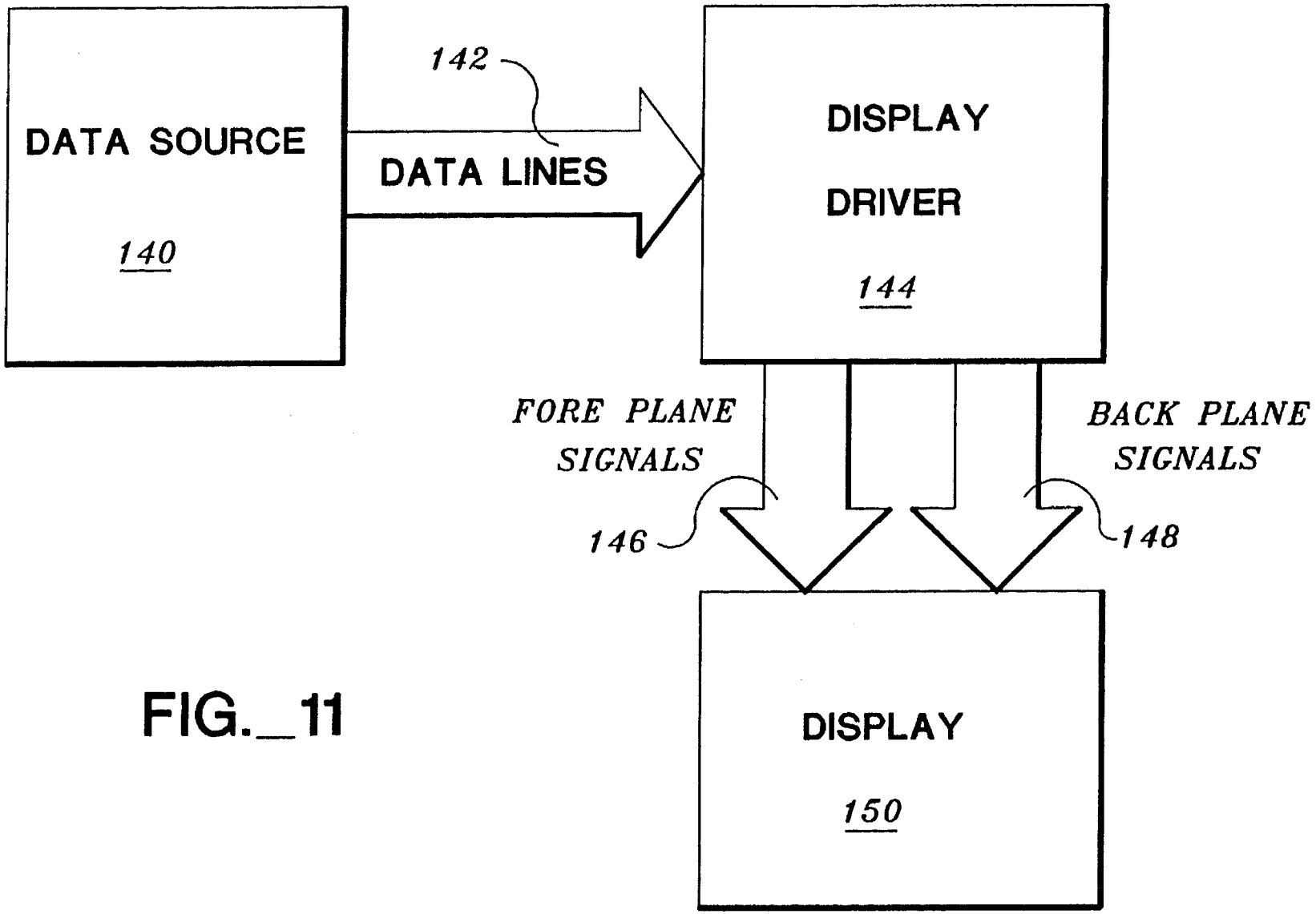
FIG. 11 is a schematic block diagram showing a first embodiment of the drive circuitry for the redundant segment display.

An appropriate circuit for driving any of the redundant segment characters 14, 18, 80, or 84 is shown in FIG. 11. In this figure, a data source 140 comprising, for example, a central processing unit (CPU) or the controller of an instrument, provides a binary signal to a display driver 144 over data lines 142 that indicates the desired character to be visually shown on a display 150. Display 150, as noted above, comprise any of the disclosed preferred embodiments for a redundant segment display in accordance with the present invention. Display driver 144 interprets the binary signal provided by data source 140 and produces corresponding fore plane drive signals 146 and back plane drive signals 148 that are coupled to display 150 to control each of the segments on the display, as described above. Display driver 144 comprise, for example, a Motorola type MC145000 Master LCD driver circuit. If more than one character is included, the additional characters can be controlled using, for example, a Motorola type MC145001 Slave LCD driver circuit for each additional character used in the display. Such display drivers or their equivalents are readily configured to provide the multiplexed fore plane and back plane drive signals described above in connection with display characters 14 and 80, and are configured in a more conventional manner to provide the fore plane and back plane drive signals for display characters 18 and 84, in which each portion of the seven segment display configuration comprises pairs of redundant segments that are provided fore plane and back plane drive signals, in parallel, by display driver 144.

Figure 12:
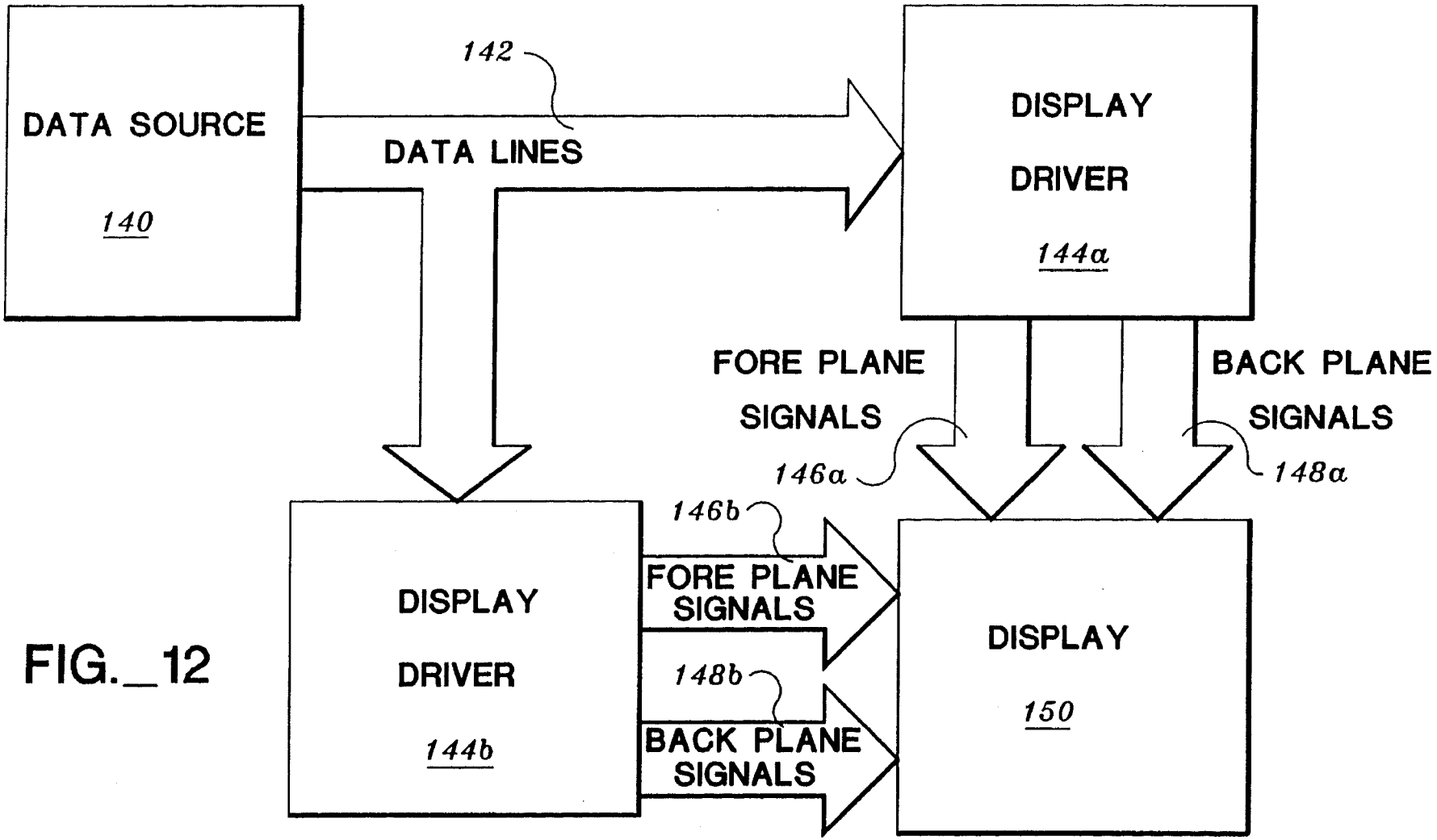
FIG. 12 is a schematic block diagram showing a second embodiment of the drive circuitry for the redundant segment display, in which separate drivers are provided for the segments comprising each redundant pair of segments.

A further level of protection against failure of a segment caused by malfunction of display driver 144 is achieved as shown in FIG. 12. In this embodiment, data source 140 is coupled through data lines 142 to both a display driver 144*a* and a display driver 144*b*. In this case, both display drivers 144*a* and 144*b* convert the binary signals indicative of a particular desired character into appropriate fore plane and back plane drive signals, which are conveyed through lines 146*a* and 148*a* to one segment of each of the pairs of redundant segments comprising redundant segment characters 18 or 84. Similarly, display driver 144*b* provides corresponding fore plane and back plane drive signals that are conveyed over lines 146*b* and 148*b*, respectively, to the other segments comprising each of the pairs of redundant segments in redundant segment characters 18 or 84. Thus, even if one of the display drivers 144*a* and 144*b* should fail, the remaining segments activated by the other display driver continue to indicate the desired character. Such failure would be readily apparent.

In each of the embodiments discussed above, a fail safe display is provided that gives the operator an indication of a failure, either because the indicated character is clearly not a number or because only one of two redundant segments is not illuminated when the other segment of the pair is. When such a failure is noted, it becomes incumbent on the operator to immediately have the instrument in which the display is installed repaired. Continued reliance on a display with a defective segment could lead to a situation wherein both of the segments comprising a pair fail, so that the failure is no longer evident.

While the present invention has been primarily described in connection with display characters intended to graphically represent numeric characters 0 through 9, it should also be evident that the same technique can be used in connection with redundant segment characters 18 and 84 as a fail-safe indication of alphanumeric characters. Furthermore, the invention is not in any way limited to redundant pairs of segments used in connection with a display character having only seven portions that can be selectively activated. The same techniques can be applied in a more general sense to graphic icons and to other more complex alphanumeric displays that are capable of displaying any alphanumeric character or graphic. For example, a graphic icon representing an alarm in the form of a bell-shaped icon could be formed by parallel, separately controlled segments so that failure of one or more of the segments to be activated would not preclude the user from visually perceiving the bell as an indication that an alarm condition has occurred.

It is also possible to use other types of display technology in connection with redundant segment characters. For example, LED segments can be fabricated in the same configuration as any of the embodiments of the invention disclosed above and a failure of any portion of the display would be apparent in the same manner already described in connection with redundant segment characters formed used LCD technology.

These and other modifications to the present invention will be apparent to those of ordinary skill in the art within the scope of the claims that follow. Accordingly, it is not intended that the scope of the invention in anyway be limited by the disclosure of the preferred embodiments, but instead that it be determined entirely by reference to the claims that follow.

The embodiments of the invention in which an exclusive property or privilege is claimed are defined as follows:

1. A display circuit, comprising:

(a) a substrate on which is defined a circuit of conducting traces;

(b) a plurality of segments electrically coupled to the conducting traces and configured in a predefined pattern on said substrate, at least some of the segments being configured in segment pairs, each segment pair including a first and a second segment that are proximate to each other and extend in a common direction, but are spaced apart, each segment pair comprising a portion of at least one icon character;

(c) segment control means, coupled to the segments, for causing selected ones of said segments to be visually perceptible by simultaneously energizing each first segment in a segment pair whenever each second segment in a segment pair is energized, said selected ones of the segments thereby visually representing a desired icon character; and (d) whereby a defective segment pair that includes a failed segment and an operating segment continues to accurately represent a part of the desired icon character, said failed segment providing a visual warning that one of the first and the second segments comprising that defective segment pair has failed by appearing visually different than the operating segment of that defective segment pair.

2. The display circuit of claim 1, wherein the segment control means are separately coupled to the first and the second segments comprising selected segment pairs, so that the first and second segments comprising each segment pair are both selectively activated and inactivated by the segment control means if the segment pair does not include a failed segment.

3. The display circuit of claim 1, wherein the segments comprise liquid crystal display regions, each region being defined by a pattern of a conductor formed on the substrate to which the conducting traces are coupled.

4. The display circuit of claim 1, wherein the segments represent a numeral eight when all segments are visually perceptible.

5. The display circuit of claim 1, wherein seven segment pairs are provided, and wherein said segment control means selectively cause specific ones of the seven segment pairs to be visually perceptible to represent at least numeric characters zero through nine.

6. The display circuit of claim 1, wherein said substrate includes regions that define a plurality of characters, at least some of which include the segment pairs.

7. The alphanumeric character display circuit of claim 1, wherein the segment pairs are used only for portions of a character, said portions of the character being selected to minimize errors in visual perception of an alphanumeric character indicated thereby caused by a failure of one of the first and second segments comprising any of the segment pairs of said character.

8. The display circuit of claim 1, wherein the first and second segments of a segment pair are parallel to each other.

9. The display circuit of claim 1 wherein the first and second segments of a segment pair are aligned along a common axis.

10. A fail-safe character display circuit, comprising:

(a) a substrate having at least two layers, an electrically conductive back plane, and a circuit comprising conducting traces formed on the substrate, at least one alphanumeric character being defined by electrically conductive regions applied to the substrate that are electrically coupled to the conducting traces, an electrical field developed between selected ones of the electrically conductive regions and the back plane in response to an applied voltage visually affecting said selected ones of said electrically conductive regions to visually represent segments defining at least one alphanumeric character, at least some of said electrically conductive regions being configured as pairs of closely spaced apart segments that extend in a common direction, arranged in a predefined pattern;

(b) a liquid crystal layer disposed between said at least two layers of the substrate, optically perceptible properties of portions of said liquid crystal layer changing in response to the electric field; and (c) control means, coupled through the conducting traces to the electrically conductive regions, for controlling the segments to cause selected segments to be visually perceptible in order to represent a desired character, wherein one of each pair of segments is energized whenever the other of each pair of segments is energized so that a failure of one segment comprising the pair of segments is visually evident, the other segment comprising that pair of segments continuing to be visually perceptible when selected by the control means so that the selected segments continue to accurately represent the desired character.

11. The fail-safe character display circuit of claim 10, wherein there are seven electrically conductive regions, and correspondingly, seven segments, formed on the substrate to visually represent one character.

12. The fail-safe character display circuit of claim 10, wherein the electrically conductive regions represent a numeral eight if all segments comprising an alphanumeric character are simultaneously visually perceptible.

13. The fail-safe character display circuit of claim 10, wherein the control means are electrically coupled to the electrically conductive regions through conducting traces formed in different planes on the layers comprising the substrate.

14. The fail-safe character display circuit of claim 10, wherein separately activated segments comprise pairs of the segments only at selected portions of the alphanumeric character, said portions being selected to minimize errors in the character visually perceived if a segment fails.

15. The fail-safe character display circuit of claim 10, wherein the segments comprising a pair are parallel to each other.

16. The fail-safe character display circuit of claim 10, wherein the segments comprising a pair are aligned along a common axis, with an end of one adjacent an end of the other.

17. A fail-safe visual display character, comprising:

(a) segment means, for visually representing a desired icon character in response to electrical signals, said segment means including redundant segment means for accurately representing the desired icon character during a failure mode in which the segment means are partially inoperative, said redundant segment means having first and second parts that are proximate to each other and extend in a common direction for each portion of an icon character in which the redundant segment means are disposed, only one part of which must be operative in response to the electrical signals to visually represent a selected portion of the icon character; and (b) control means for producing the signals to selectively energize the segment means and visually display the desired icon character, the first part of the redundant segment means being energized whenever the second part of the redundant segment means is energized so that a failure of one of the first and second parts of the redundant segment means is evident when only one of the first and second parts responds to the electrical signals.

18. The fail-safe visual display of claim 17, wherein the desired icon character is selected from among a group of characters consisting of the numbers zero through nine.

19. The fail-safe visual display of claim 17, wherein the redundant segment means include a plurality of elongate liquid crystal regions defined on a substrate, said liquid crystal regions optically changing in response to the electrical signals to cause the liquid crystal regions to be visually perceptible.

20. The fail-safe visual display of claim 17, wherein the control means comprise an electronic circuit for producing the electrical signals to select the desired icon character in response to a digital signal.

21. The fail-safe visual display of claim 17, wherein the segment means are selectively energized to represent a plurality of characters, arranged in a multi-digit format.

22. The fail-safe visual display of claim 17, wherein the segment means include seven parts that are selectively energizable to visually represent a desired icon character, all seven pans visually representing a number eight if simultaneously energized.

23. The fail-safe visual display of claim 17, wherein the control means comprise first and second display drivers, both of the first and second display drivers separately providing identical electrical signals to the first and second parallel parts comprising the redundant segment means, so that failure of one of the first and second display drivers does not prevent the accurate visual perception of the desired icon character.

24. The fail-safe visual display of claim 17, wherein the redundant segment means comprise only selected portions of the icon character, said portions being selected so as to minimize errors in visual perception of the desired icon character due to operation in the failure mode.

25. The fail-safe visual display of claim 17, wherein the first and second parts of the redundant segment means are parallel where said parts represent a portion of the icon character.

26. The fail-safe visual display of claim 17, wherein the first and second parts of the redundant segment means are aligned with an end of a first part being adjacent to an end of a second part where said parts represent a portion of the icon character.

* * * * *

UNITED STATES PATENT AND TRADEMARK OFFICE

CERTIFICATE OF CORRECTION

PATENT NO. : 5,559,528

DATED : September 24, 1996

INVENTOR(S) : A. Ravid et al.

It is certified that error appears in the above-indentified patent and that said Letters Patent is hereby corrected as shown below:

| COLUMN | LINE | |
|---|---|---|
| 14 (Claim 22, | 2 line 4) | "pans" should read --parts-- |

Signed and Sealed this

Twenty-fifth Day of March, 1997

*Attest:*

*Attesting Officer*

BRUCE LEHMAN

*Commissioner of Patents and Trademarks*